US006090463A

United States Patent [19]

Sakaki et al.

[11] Patent Number: 6,090,463

[45] Date of Patent: Jul. 18, 2000

[54] CLEANING SHEET CLEANING METHOD OF RECORDING APPARATUS USING THE SAME AND STACK OF RECORDING MEDIUM CONTAINING THE SAME

[75] Inventors: Mamoru Sakaki, Yamato; Masato Katayama, Yokohama, both of Japan

[73] Assignee: Canon Kabushiki Kaisha, Tokyo, Japan

[21] Appl. No.: 08/919,238

[22] Filed: Aug. 28, 1997

[30] Foreign Application Priority Data

Sep. 4, 1996 [JP] Japan ..... 8-252198
Aug. 4, 1997 [JP] Japan ..... 9-221209

[51] Int. Cl.[7] ..... G03G 21/00

[52] U.S. Cl. ..... 428/42.1; 15/256.51; 271/37; 428/40.2; 428/41.8; 428/42.2; 428/156; 428/194

[58] Field of Search ..... 428/40.1, 40.2, 428/41.8, 42.2, 343, 194, 156, 172, 42.1; 15/256.51; 271/37

[56] References Cited

U.S. PATENT DOCUMENTS 4,542,059 9/1985 Toganoh et al. ..... 428/141
5,616,386 4/1997 Okada ..... 428/40.1

FOREIGN PATENT DOCUMENTS 0531992 3/1972 European Pat. Off. .
2731528 9/1996 France .
8809610 9/1988 Germany .
08-175041 7/1996 Japan .

OTHER PUBLICATIONS

Pat. Abs. Jp., vol. 96, 11, 11/29/96 (JP 08 175041 A).
Pat. Abs. Jp., vol. 17, No. 389(M–1449), 7/21/93 (JP 05 069654 A).

*Primary Examiner*—Nasser Ahmad
*Attorney, Agent, or Firm*—Fitzpatrick, Cella, Harper & Scinto

[57] ABSTRACT

A cleaning sheet suitable for use in cleaning a recording apparatus including a region having an adhesive property provided on at least a part of one surface of a base sheet, and the other surface of the base sheet has a surface roughness ranging from 15 um to 60 um in terms of a ten point mean roughness Rz at a reference length of 8 mm in accordance with JIS B 0601. The surface roughness A um and the adhesive strength of B gf/25 mm satisfy the following relationship:

$$0.05 \leq A/B.$$

12 Claims, 2 Drawing Sheets

CLEANING SHEET CLEANING METHOD OF RECORDING APPARATUS USING THE SAME AND STACK OF RECORDING MEDIUM CONTAINING THE SAME

BACKGROUND OF THE INVENTION

1. Field of the Invention

The present invention relates to a cleaning sheet suitable for use in maintaining a recording apparatus in which sheets of recording medium composed of coated paper are used to conduct recording, a cleaning method of a recording apparatus with such a cleaning sheet, and a stack of recording medium containing such a cleaning sheet.

2. Related Background Art

In a recording apparatus equipped with a paper feeding means for feeding one recording paper sheet from stacked plural sheets of recording paper (a pile of recording medium) toward a recording section of the recording apparatus in contact with a recording surface of the recording paper sheet, there has heretofore been widely used a paper feeding system provided with a separating means for separating a recording medium from stacked sheets of the recording medium for preventing a multi-sheet feed that plural sheets of recording medium are fed in piles, which occurs in the course of the feeding. FIG. 1 illustrates an exemplary recording apparatus equipped with such a separating means for a recording medium. The recording apparatus illustrated in FIG. 1 will hereinafter be described.

In FIG. 1, reference numeral 1 designates a paper feed tray. Sheets of recording medium 2 stacked thereon are successively fed onto a platen 9 in the following manner. Namely, when paper feed rollers 3 (feeding means) in the form of a semicylinder, which are provided over the recording medium 2, are rotated counterclockwise on their axis, the feed rollers 3 come into contact with a recording surface of the recording medium 2, so that the recording medium 2 is fed toward the platen 9 with the rotation of the feed roller 3.

A separating means in the recording apparatus illustrated in FIG. 1 is a separation pad 4 provided before the platen 9. The separation pad 4 is in contact with a back surface of the recording medium 2 upon the feeding of the recording medium 2. If two or more sheets of the recording medium 2 are fed in piles, the recording medium 2 in piles are separated from each other by utilizing frictional force between the pad 4 and the back surface of the recording medium 2. As a result, only one recording medium 2 among the stack is conveyed onto the platen 9 by a conveyor roller 5. An image is recorded by a recording head 6 on the recording medium 2 conveyed through the conveyor roller 5 to a recording section of the recording apparatus. Thereafter, the recording medium 2 on which the image has been recorded is discharged through a paper discharge roller 7 and stacked on a paper discharge tray 8.

FIG. 2 is a schematic view of a recording apparatus viewed from the above for the purpose of illustrating a flow of a recording medium in the recording apparatus. In an example illustrated in FIG. 2, a separation claw 10 is provided as a separating means. In FIG. 2, reference numeral 1 designates a paper feed tray. Similarly, as described in FIG. 1, sheets of recording medium 2 stacked on the paper feed tray are fed by rotating a paper feed rollers 3 (feeding means) in the form of a semicylinder and contacting the rollers 3 with a recording surface of the recording medium 2. The recording medium 2 thus fed is conveyed onto a platen 9 by a conveyor roller 5. Upon the paper feeding, only one sheet is separated by the separation claw 10 provided at a corner of the paper feed tray as illustrated in FIG. 2 and fed. The system making use of this separation claw is well known. As illustrated in FIG. 2, the separation claw 10 is so constructed that it is engaged with a corner of a stack of recording medium so as to separate only one sheet upon making good use of the stiffness of the paper. Reference numerals 5, 6, 7 and 8 have each the same meaning as those mentioned in FIG. 1.

On the other hand, in recording using inks of many different colors, in particular, in a full-color ink-jet recording system, coated paper composed of a base material and a coating layer containing a pigment provided thereon is widely used as a recording medium because it is excellent in coloring ability with inks and ink absorbency and can provide a clear image. However, when a recording medium having, in particular, the above-described coating layer is continuously used in quantity in the above-described recording apparatus which has a separating means for recording paper sheets stacked and can conduct continuous recording, a failure of paper passage often occurs due to the influence of paper dust (pigment and the like) fallen off from the coating layer, which poses a problem.

In order to solve such a problem, Japanese Patent Application Laid-Open No. 5-69654 has proposed a cleaning sheet in which a layer having a specific adhesive property is provided on its surface. More specifically, when the sheet is fed into the course of conveyance in a recording apparatus, the paper dust fallen off from the coating layer is stuck to the layer having the specific adhesive property and removed from the course of conveyance, thereby cleaning the recording apparatus. Since this sheet is provided with the adhesive layer on its whole surface, however, the cleaning sheet itself may jam in the recording apparatus in some cases according to use conditions though its cleaning effect can be fully achieved. In addition, in the above-described cleaning sheet, the adhesive layer is provided only on the front surface thereof, so that its cleaning effect on portions of the conveying means, with which the back surface of the sheet comes into contact, is insufficient though its cleaning effect can be sufficiently exhibited on portions of the paper feeding means and the conveying means, with which the front surface comes into contact.

Japanese Patent Application Laid-Open No. 8-175041 describes a cleaning method of an image forming apparatus in which a heating member is brought into contact with a heat-sensitive recording medium to form an image, and the use of a cleaning sheet provided with an adhesive on a part or the whole of the front surface thereof.

As an example of such a cleaning sheet, a sheet obtained by coating a part of one surface of a base material with an adhesive and roughening another part of the surface is described. With respect to this cleaning sheet, it is described to clean a thermal head by rubbing the thermal head with the roughened region of the cleaning sheet and to clean a hot stamp for image erasing by pressing the adhesive region of the cleaning sheet against the hot stamp.

As another example of the cleaning sheet, a sheet obtained by coating a part or the whole of one surface of a base material with an adhesive and roughening a part or the whole of the other surface is also suggested.

However, the function of the roughened region of the surface opposite to the adhesive surface is not described at all. In addition, the degree of roughening is also not described.

SUMMARY OF THE INVENTION

Accordingly, it is an object of the present invention to provide a cleaning sheet which can be simply used in the maintenance of a recording apparatus for the purpose of effectively preventing a failure of paper passage in the recording apparatus, such as multi-sheet feed or paper jam, to achieve a smooth and continuous paper feed from a stack of recording medium, a cleaning method using such a cleaning sheet, and a stack of recording medium containing such a cleaning sheet.

Another object of the present invention is to provide a cleaning sheet the handling properties of which have been improved so as to prevent an occurrence of a phenomenon that a cleaning sheet itself jams in a recording apparatus even when the sheet is used under any conditions, a cleaning method of a recording apparatus using such a cleaning sheet, and a stack of recording medium containing such a cleaning sheet.

The above objects can be achieved by the present invention described below.

According to the present invention, there is thus provided a cleaning sheet suitable for use in cleaning a recording apparatus, wherein a region having an adhesive property is provided on at least a part of one surface of a base sheet, and the other surface of the base sheet has a surface roughness ranging from 15 $\mu$m to 60 $\mu$m in terms of a ten point mean roughness Rz at a reference length of 8 mm in accordance with JIS B 0601. The surface roughness A um and the adhesive strength of B gf/25 mm satisfy the following relationship:

$$0.05 \leq A/B.$$

According to the present invention, there is also provided a cleaning method of a recording apparatus comprising a paper feeding means for feeding a recording medium to a conveying means while coming into contact with the recording surface of the recording medium, and the conveying means for conveying the recording medium fed to a recording position while coming into contact with the back surface of the recording medium and discharging the recording medium after an image is formed on the recording medium, wherein the cleaning sheet described above is fed to, conveyed through and discharged from the recording apparatus.

According to the present invention, there is further provided a stack of recording medium, comprising a plurality of sheets of recording medium comprising a base material and a coating layer containing a pigment provided on the base material, and the above-described cleaning sheet stacked thereon.

DETAILED DESCRIPTION OF THE PREFERRED EMBODIMENTS

Figure 1:
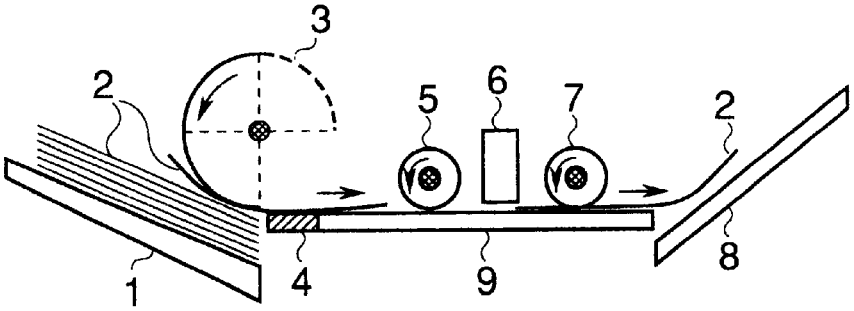
FIG. 1 is a conceptual drawing illustrating an exemplary recording apparatus which is suited to use a cleaning sheet according to the present invention.
Figure 2:
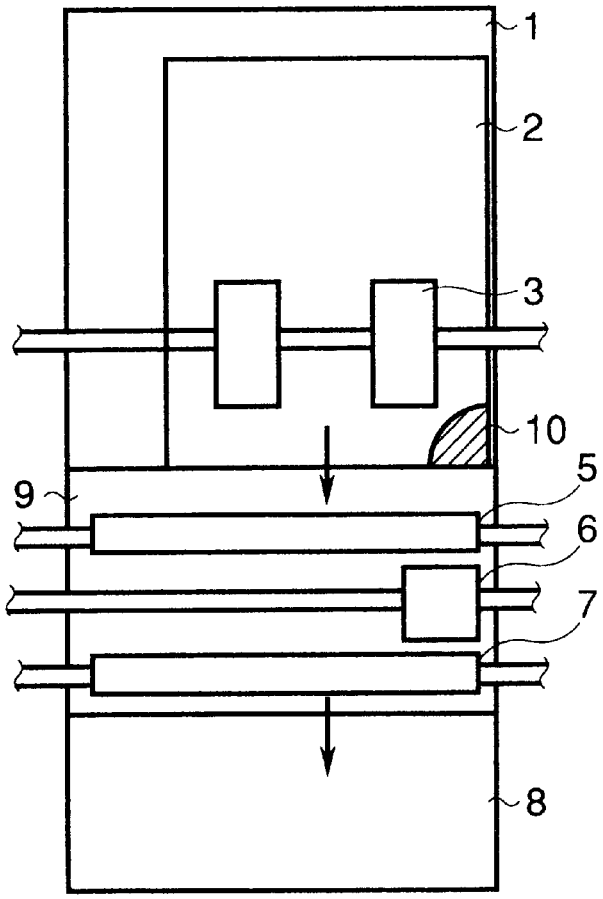
FIG. 2 is a conceptual drawing illustrating another exemplary recording apparatus which is suited to use a cleaning sheet according to the present invention.

The present invention will hereinafter be described in more detail in accordance with preferred embodiments.

The present inventors have carried out an extensive investigation with a view toward solving the above-described problems involved in the prior art. As a result, it has been found that a failure of paper passage in a recording apparatus, which occurs when sheets of coated paper are continuously used as described above, is attributed to, in particular, either the fact that a pigment separated from a coating layer attaches to the respective means for feeding, separating and conveying the recording medium to reduce frictional force between these means and the recording medium or the fact that the feeding, separating and conveying means are scraped off by the pigment attached thereto, or a combination thereof, and that these causes exert a great influence on the failure of paper passage. In contrast, the present inventors have found that when a cleaning sheet having specific properties is passed through the recording apparatus on a specific cycle, the foreign matter on the feeding, separating and conveying means is removed with special effect, and so the occurrence of failure of paper passage can be prevented by merely passing the cleaning sheet through the recording apparatus, thus leading to completion of the present invention.

The present inventors have further found that in order to provide a cleaning sheet which does not cause jam of the cleaning sheet itself in a recording apparatus even under various environmental conditions and also has excellent handling properties in addition to excellent cleaning performance for the recording apparatus, it is important that an adhesive region is provided on a part of a surface, not the whole thereof, that the surface opposite to the surface having the adhesive region is a matted surface having a specific surface roughness and that a plastic sheet is preferably used as a base material, thus leading to completion of the present invention.

More specifically, when an adhesive region is provided on one surface of a cleaning sheet, this region may stick to the interior of a recording apparatus in some cases, for example, under environmental conditions of a high-temperature and a high-humidity. When the opposite surface of the cleaning sheet is adjusted so as to have a specific surface roughness, however, frictional force between the cleaning sheet and a conveyor roller can be maintained large even when paper dust such as a pigment is attached in plenty to the conveyor roller. Therefore, the jam of the cleaning sheet itself can be prevented. At the same time, the foreign matter on the surface of the conveying means is scraped off by the matted surface provided on the side opposite to the surface provided with the adhesive region upon the conveyance of the sheet, and so smooth conveyance is feasible.

According to the cleaning sheet of the present invention, as described above, a failure of paper passage, which tends to occur upon recording using the coated paper in plenty, can be prevented.

Figure 3A:
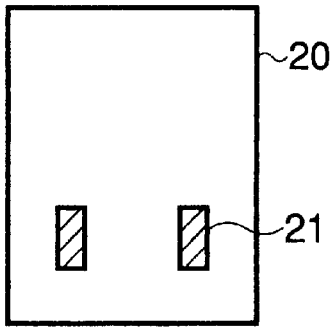
FIG. 3A is a plan view illustrating an exemplary adhesive surface (front surface) of a cleaning sheet according to the present invention.
Figure 3B:
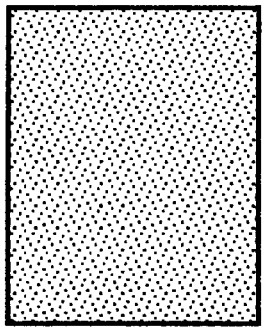
FIG. 3B is a plan view illustrating an exemplary matted surface (back surface) of the cleaning sheet according to the present invention.
Figure 4:
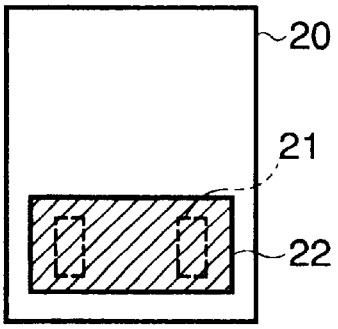
FIG. 4 is a plan view illustrating an exemplary cleaning sheet according to the present invention.

The construction of the cleaning sheets according to the present invention will hereinafter be described. An exemplary cleaning sheet according to the present invention is illustrated in FIGS. 3A and 3B. As illustrated in FIG. 3A, a region 21 having an adhesive property is provided on one surface of a base material 20 in the cleaning sheet according to the present invention. The region 21 having an adhesive property is preferably provided at least at a position coming into contact with a feeding means, for example, as illustrated in FIG. 3A. However, the region 22 having an adhesive property may be provided in a wider portion including the portion 21, not only in the portion coming into contact with the feeding means, as illustrated in FIG. 4. The cleaning sheet according to the present invention is preferably so constructed that the region 22 having an adhesive property is covered with release paper before use to prevent blocking with another member, and the release paper is released when the cleaning sheet is used. FIG. 3B shows a matted surface (back surface) of the cleaning sheet which has been subjected to a roughening treatment.

As a material for constructing the region 21 or the region 22 having an adhesive property, any conventionally-known pressure sensitive adhesive may be used without any limitation. Specific examples thereof include pressure sensitive adhesives composed of natural rubber, synthetic rubber such as butyl rubber and the like, an acrylate copolymer, a silicone resin, or a vinyl ether copolymer, combined type pressure sensitive adhesives using these components in combination, and high-molecular pressure sensitive adhesives such as ethylene-vinyl acetate copolymers, styrene-butadiene copolymers and styrene-isoprene copolymers. When the region having an adhesive property is formed, it is possible to add and use a tackifying resin of the rosin, petroleum or terpene type, a tack adjustor and an adhesion improver, and besides various additives such as antioxidants, stabilizers and colorants, as needed, in addition to the above-described pressure sensitive adhesive.

In the cleaning sheet according to the present invention, the region having an adhesive property is formed by coating at least a part of one surface of the base sheet 20 with the pressure sensitive adhesive and the like as described above or dipping the surface therein. At this time, the amount of the pressure sensitive adhesive to be applied is preferably within a range of from 0.5 to 50 g/m$^2$. The adhesive strength of the region having an adhesive property can be suitably controlled by, for example, the molecular weight of the pressure sensitive adhesive used, the amount of the pressure sensitive adhesive applied and the like.

The adhesive strength of the region having an adhesive property of the cleaning sheet according to the present invention, which is formed in the above-described manner, may be sufficient to stick paper dust such as a pigment attached to the feeding means to the region when the cleaning sheet is passed through the feeding means, thereby removing the paper dust from the feeding means. For example, the adhesive strength of the region having an adhesive property of the cleaning sheet according to the present invention is preferably within a range of from 300 to 800 gf/25 mm, more preferably from 300 to 500 gf/25 mm, as measured by the 180° peeling test in accordance with JIS Z 1528 (pressure sensitive adhesive double coated tapes) under environmental conditions of a temperature of 23° C. and a relative humidity of 55%. If the adhesive strength value is lower than 300 gf/25 mm, the adhesive strength is too weak to surely expect its effect as a cleaning sheet for sticking the paper dust such as the pigment to the region to remove it. If the adhesive strength value exceeds 800 gf/25 mm, on the other hand, the resulting cleaning sheet tends to cause sticking of the cleaning sheet to the feeding means when the sheet is passed through the recording apparatus, resulting in difficulty in normally conveying the cleaning sheet itself. Therefore, such a cleaning sheet is poor in usage.

In the present invention, the adhesive strength of the region having an adhesive property of the cleaning sheet according to the present invention can be measured in the following manner. A region having an adhesive property is first provided in a size of 30 mm×78 mm on a polyester film having a thickness of 12 $\mu$m. The polyester film on which the region having an adhesive property has been provided is placed on a stainless steel plate (SUS 304, #280 polished surface), and both are press-bonded to each other by reciprocating a 2-kg rubber roller once on the polyester film, thereby preparing a sample for measurement. Using the sample for measurement, the polyester film is peeled from the stainless steel plate at a rate of 300 mm/min, thereby measuring a force required to peel the polyester film with an angle of 180° to regard the force as the adhesive strength calculated in the terms of a value per 25 mm width.

As a method for forming the region having an adhesive property of the cleaning sheet according to the present invention, it is also preferable to use the so-called pressure sensitive adhesive double coated tape on one side of which an adhesive surface having a desired adhesive strength has been formed in advance. This method is suitable for use in producing a cleaning sheet provided with a region having an adhesive property at only a portion coming into contact with a feeding means as illustrated in FIG. 3A. In this case, however, generally marketed industrial pressure sensitive adhesive double coated tapes have the same adhesive strength at both sides, and the adhesive strength is greater than 800 gf/25 mm, so that they cannot be used. As a double coated tape usable for forming the region having an adhesive property of the cleaning sheet according to the present invention, there is used a tape one surface of which has adhesive strength ranging from 300 to 800 gf/25 mm and the other surface of which preferably has adhesive strength higher than 800 gf/25 mm. This tape is used so as to bond the surface having a higher adhesive strength to a desired position on a base material.

The greatest feature of the cleaning sheet according to the present invention resides in that the above-described region 21 having an adhesive property is provided on one surface of the base material, and a the same time the surface opposite to the surface having the adhesive region is a surface having a specific surface roughness, as shown in FIG. 3B. More specifically, the surface opposite to the surface having the adhesive region in the cleaning sheet according to the present invention is required to be subjected to a matting treatment and have a surface roughness ranging from 15 $\mu$m to 60 $\mu$m, preferably from 20 to 55 $\mu$m, in terms of a ten point mean roughness, Rz, at a reference length of 8 mm. Incidentally, the ten point mean roughness in the present invention is a value measured by the method in accordance with JIS B 0601.

Any method may be used as a method for adjusting the surface roughness of the one surface of the cleaning sheet according to the present invention within the above range. In the present invention, however, it is preferable to use a method in which the surface is matted to a desired roughness by subjecting it to a sandblasting treatment. The sandblasting treatment itself is a well known method in which any of various kinds of abrasives is blown against a surface of a film to engrave the surface so as to be matted. The surface roughness formed at this time is varied depending on kinds, particle size, blowing time and blowing intensity of the abrasives used, and the like.

In order to achieve the greater surface roughness as in the present invention, it is important to use abrasives having a particle size greater than that of any abrasives generally used in a sandblasting treatment.

If the value o f Rz representing the surface roughness is smaller than 15 $\mu$m, the resulting cleaning sheet tends to slip on a conveying means to which paper dust has been attached when the sheet is passed through a recording apparatus, resulting in difficulty in achieving the effect of preventing jam of the cleaning sheet itself. In addition, such a cleaning sheet is also small in the effect of scraping off foreign matters composed of paper dust such as a pigment attached to the surface of the conveying means to clean the conveying means. If the value of Rz is greater than 60 $\mu$m to have excessive roughness on the other hand, the stiffness of the resulting cleaning sheet itself becomes low, so that the sheet may stick to a feeding means in some cases upon the feeding of the sheet.

In the cleaning sheet according to the present invention, the preferable adhesion strength of the region having an adhesive property and the preferable range of the surface roughness of the surface subjected to the matting treatment, i.e., the back surface, are as described above. In view of the handling properties of the cleaning sheet, however, the cleaning sheet preferably satisfies the relationship of the formula $0.05<A/B$, supposing that Rz of the back surface is A $\mu$m and the adhesive strength of the region having an adhesive property is B gf/25 mm. Namely, since greater force of conveyance is required when the adhesive strength is higher, it is also necessary that the roughness of the back surface be higher.

No particular limitation is imposed on the form of the cleaning sheet according to the present invention, which has the above-described construction as to both surfaces. However, it preferably has the same form as a recording medium. As the base material 20 used in the cleaning sheet according to the present invention, any material such as paper or plastic may be used so far as it is in the form of a sheet. In the present invention, however, it is particularly preferable to use a plastic film which undergoes little change of stiffness by environmental changes of temperature, humidity and the like. More specifically, when paper is used as the base material, the stiffness of the resulting cleaning sheet will be lost under environmental conditions of a high-humidity because the paper has high hygroscopicity. Consequently, its force for withstanding conveyance is weakened, and the adhesive region thereof sticks to a part within a recording apparatus under environmental conditions of a high-humidity, so that such a cleaning sheet tends to cause paper jam. Examples of the plastic film include films of polyethylene terephthalate, polyethylene, polypropylene, polyvinyl chloride, polystyrene and the like. When a plastic film is used as the base material in the present invention, the thickness of the film is preferably within a range of from 125 to 200 $\mu$m. If the thickness of the film is thinner than the lower limit of the above range, the stiffness of the base material is lost, resulting in a cleaning sheet which tends to cause jam of the sheet itself. On the other hand, if the plastic film is too thick, namely, the stiffness of the base material is too high, the resulting cleaning sheet tends to pose a problem as to the conveyability of the sheet itself.

Figure 5:
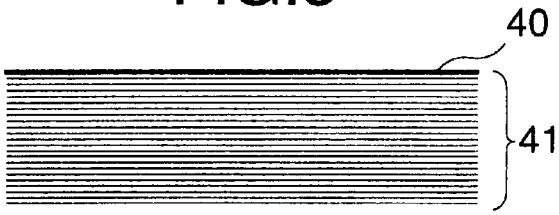
FIG. 5 is a conceptual drawing illustrating an exemplary stack of recording medium according to the present invention.

FIG. 5 is a schematic view illustrating a stack of recording medium containing the cleaning sheet according to the present invention as described above. As illustrated in FIG. 5, the stack of recording medium according to the present invention has a structure that a cleaning sheet 40 and a plurality of sheets of a recording medium 41 are stacked on each other. In the present invention, no particular limitation is imposed on the number of sheets of the recording medium stacked. The number thereof is determined in view of handling and the like. The present inventors have investigated as to the number thereof. As a result, it has been experimentally confirmed that the sheets of recording medium are preferably stacked in a proportion of 20 to 500 sheets per cleaning sheet.

The cleaning sheet is not necessarily stacked on the top of the sheets of recording medium as illustrated in FIG. 5, and may be interposed between the sheets of recording medium in the above-described proportion. In any case, the adhesive region provided on the cleaning sheet according to the present invention is preferably protected by release paper for the purpose of preventing blocking with another member.

The cleaning sheet according to the present invention as described above has a marked effect when it is used in maintaining a recording apparatus which can continuously conduct recording on recording medium successively fed and which comprises a stack of recording medium stacked with plural sheets of recording medium comprising a base material and a recording surface composed of a coating layer containing a pigment provided on the base material, a paper feeding means for feeding a recording medium among the stack of recording medium to a conveying means while coming into contact with the recording surface of the recording medium, a separating means for separating one sheet of the recording medium to be fed from other sheet of recording medium forming the stack of recording medium, and the conveying means for conveying the recording medium fed to a recording position while coming into contact with the back surface of the recording medium and discharging the recording medium after an image is formed on the recording surface of the recording medium.

The recording medium which is generally used in the recording apparatus described above and comprises a base material and a recording surface composed of a coating layer containing a pigment provided on the base material will hereinafter be described.

Figure 6:
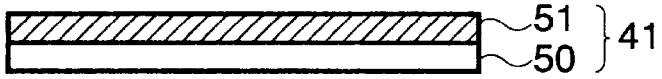
FIG. 6 is a conceptual drawing illustrating an exemplary recording medium generally used in recording apparatus.

FIG. 6 illustrates an example of a recording medium 41 provided with a coating layer. A base material 50 is generally formed of paper or a plastic film. The coating layer 51 is provided on a recording surface of the base material 50. The coating layer 51 is a porous layer having an excellent ability to adsorb a dye in the ink and is composed mainly of an inorganic or organic pigment and a binder resin. Such a recording medium is conventionally known. In addition to the above structure, a back coating layer may be further provided on a back side of the base material 50 for preventing curling and the like, as needed.

The present invention will hereinafter be described in more detail by the following Examples and Comparative Examples.

EXAMPLES 1 to 4 AND COMPARATIVE EXAMPLES 1 to 3

<Production of Cleaning Sheets 1 to 6>

A polyethylene terephthalate film (thickness: 150 $\mu$m, dimensions: 210×297 mm) was used as a base material for a cleaning sheet, and alumina particles were used as abrasives. Only each one side of five pieces of the base material was subjected to a sandblasting treatment so as to provide a surface roughness of #40, #60, #80, #100 and #150, respectively. Each of the other sides of the base materials had been subjected to a matting treatment were provided as Base Materials 1 to 5, respectively. The untreated base material subjected to neither sandblasting treatment, nor matting treatment was provided as Base Material 6.

Scotch brand film-based pressure sensitive adhesive double coated tape #4591HM (trade name, product of Sumitomo 3M Limited; adhesive strength of one side: 1,200 gf/25 mm; adhesive strength of the other side: 380 gf/25 mm) was stuck to a surface opposite to the matted surface of each base material with the side having higher adhesive strength down like the adhesive region 21 illustrated in FIG. 3A, thereby producing cleaning sheets. Cleaning Sheets 1 to 4 of Examples 1 to 4 according to the present invention were obtained by using Base Materials 1 to 4, respectively. On the other hand, Cleaning Sheet 5 of Comparative Example 1 was obtained by using Base Material 5. Further, Cleaning Sheet 6 of Comparative Example 2 was obtained by using Base Material 6 the one surface of which was not subjected to a matting treatment. Incidentally, the surface of the double coated tape provided on each of the respective cleaning sheets thus produced, said surface having lower adhesive strength, was protected with silicone-treated release paper. The ten point mean roughness of the matted surface of each of Cleaning Sheets 1 to 6 thus obtained was measured and found to be as shown in Table 1.

Evaluation:

<10,000-Sheet Durability Test>

A coating layer composed mainly of 2.5 parts of particulate silica (Sylysia 740, trade name, product of Fuji Silisia K.K.; average particle size: 5 um) and 1 part of polyvinyl alcohol (PVA-117, trade name, product of Kuraray Co., Ltd.) was provided on a paper substrate having a basis weight of 100 g/m$^2$ and a Stockigt sizing degree of 25 seconds at a coating weight of 20 g/m$^2$ in accordance with a method per se in the art. The thus-coated paper substrate was subjected to a supercalendering treatment, thereby producing a recording medium. The Bekk smoothness of the coated surface of the recording medium was 137 seconds.

Each of Cleaning Sheets 1 to 6 obtained above was put after the last of 200 sheets of the recording medium, thereby obtaining Stacks 1 to 6 of recording medium. Each of the thus-obtained Stacks 1 to 6 of recording medium was charged into BJC-600J (trade name, manufactured by Canon Inc.) as a recording apparatus, and continuous recording on 10,000 sheets of the recording medium was conducted. Before the recording, the release paper on each of Cleaning Sheets 1 to 6 in the stacks of recording medium was removed and the cleaning sheets were set in such a manner that one cleaning sheet per 200 sheets of the recording medium can be fed. As a result, no failure of paper passage occurred during 10,000-sheet recording even when any of Cleaning Sheets 1 to 6 was used.

On the other hand, the same recording as described above was conducted using the same stacks of recording medium as those described above except that no cleaning sheet was added. As a result, a failure of paper feeding often occurred, and paper feed was infeasible at the time when recording was conducted to 8,000 sheets, as shown as Comparative Example 3 in Table 1.

<Recovery Test of Paper Feed>

Six (6) recording apparatus were provided, which had become infeasible in paper feed upon conducting continuous recording on a plurality of sheets of recording medium having a coating layer containing a pigment in the same manner as in Comparative Example 3. Cleaning Sheets 1 to 6 from which release paper had been removed were respectively passed through the recording apparatus to clean the interiors of the apparatus. As a result, it was found that the recording apparatus cleaned by these cleaning sheets recovered their paper-feeding ability by passing Cleaning Sheets 1 to 4 respectively through the recording apparatus as usual, and so the conveyance of a recording medium became feasible. On the other hand, Cleaning Sheets 5 and 6 jammed in the recording apparatus. Further, the recording apparatus were in a state that a failure of paper passage was still occurred also after the jammed cleaning sheets were separately removed. The results are shown in Table 1.

EXAMPLE 5

A polyethylene film having a thickness of 150 $\mu$m and dimensions of 210×297 mm was provided as Base Material 7. One surface of this film was subjected to a matting treatment so as to provide a surface roughness of 35 $\mu$m in terms of a ten point mean roughness. The matting treatment to the surface was conducted by pressing the surface against a stainless steel plate heated to 180° C. The same pressure sensitive adhesive double coated tape as used in Example 1 was stuck to a surface opposite to the matted surface thus treated in the same manner as in Example 1 to form an adhesive region, thereby obtaining Cleaning Sheet 7 according to this example.

Using Cleaning Sheet 7 thus obtained, a 10,000-sheet durability test and a recovery test of paper feed were conducted in the same manner as in Cleaning Sheets 1 to 6. As a result, no failure of paper passage occurred during 10,000-sheet recording when Cleaning Sheet 7 was also used. Besides, Cleaning Sheet 7 from which release paper had been removed was passed through a recording apparatus which had become infeasible in paper feed. As a result, Cleaning Sheet 7 was able to normally pass through the recording apparatus without jamming in the recording apparatus, and the recording apparatus which had become infeasible in paper feed recovered its paper-feeding ability, and so the conveyance of a recording medium became feasible. The results are shown in Table 1.

TABLE 1

Cleaning sheets and evaluation results

| | Cleaning sheet | | Evaluation results | |
|---|---|---|---|---|
| | Base material | Ten point mean roughness ($\mu$m) | 10,000-Sheet durability test | Recovery test after failure of paper feed |
| Ex. 1 | 1 | 55 | No failure of paper passage occurred | Paper-feeding ability was recovered |
| Ex. 2 | 2 | 35 | No failure of paper passage occurred | Paper-feeding ability was recovered |
| Ex. 3 | 3 | 23 | No failure of paper passage occurred | Paper-feeding ability was recovered |
| Ex. 4 | 4 | 16 | No failure of paper passage occurred | Paper-feeding ability was recovered (in some cases, jam may occur there in apparatus when used repeatedly) |
| Comp. Ex. 1 | 5 | 12 | No failure of paper passage occurred | Jam of sheet itself occurred and failure of feeding was not recovered |
| Comp. Ex. 2 | 6 | 1(*) | No failure of paper passage occurred | Jam of sheet itself occurred and failure of feeding was not recovered |

TABLE 1-continued

| Cleaning sheets and evaluation results | | | | |
|---|---|---|---|---|
| | Cleaning sheet | | Evaluation results | |
| | Base material | Ten point mean roughness (μm) | 10,000-Sheet durability test | Recovery test after failure of paper feed |
| Comp. Ex. 3 | Not used | — | Paper feed becomes infeasible at 8,000-sheet recording | — |
| Ex. 5 | 7 | 35 | No failure of paper passage occurred | Paper-feeding ability was recovered |

Note: (*)No matting treatment was conducted.

According to the present invention, as described above, there is provided a cleaning method of a recording apparatus, in which a failure of paper passage such as multi-sheet feed or paper jam can be reliably prevented by an extremely simple method that the cleaning sheet is used in the predetermined proportion for sheets of the recording medium upon recording.

According to the present invention, there are also provided cleaning sheets having such excellent effects as described above, in which the handling properties of the sheets themselves are good, and so the cleaning sheets themselves do not jam in a recording apparatus even when the sheets are used under any conditions.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cleaning sheet suitable for use in cleaning a recording apparatus, wherein a region having an adhesive property is provided on at least a part of one surface of a base sheet, and the other surface of the base sheet has a surface roughness ranging from 15 um to 60 um in terms of a ten point mean roughness Rz at a reference length of 8 mm in accordance with JIS B 0601, wherein the surface roughness of A um and the adhesive strength of B gf/25 mm satisfy the following relationship:

$$0.05 \leq A/B.$$

2. The cleaning sheet according to claim 1, wherein the ten point mean roughness falls within a range of from 20 μm to 55 μm.

3. The cleaning sheet according to claim 1, wherein the region having an adhesive property has an adhesive strength ranging from 300 gf/25 mm to 800 gf/25 mm as measured by a 180° peeling test in accordance with JIS Z 1528.

4. The cleaning sheet according to claim 1, wherein the region having an adhesive property has an adhesive strength ranging from 300 gf/25 mm to 500 gf/25 mm as measured by a 180° peeling test in accordance with JIS Z 1528.

5. The cleaning sheet according to claim 1, wherein the thickness of the base sheet falls within a range of from 125 μm to 200 μm.

6. The cleaning sheet according to claim 1, wherein the base sheet is a plastic film.

7. A stack of recording medium, comprising a plurality of sheets of recording medium comprising a base material and a coating layer containing a pigment provided on the base material, and a cleaning sheet suitable for use in cleaning a recording apparatus, wherein a region having an adhesive property is provided on at least a part of one surface of a base sheet, and the other surface of the base sheet has a surface roughness ranging from 15 um to 60 um in terms of a ten point mean roughness Rz at a reference length of 8 mm in accordance with JIS B 0601, and wherein the surface roughness of A um and the adhesive strength of B gf/25 mm satisfy the following relationship $$0.05 \leq A/B.$$

8. The stack recording medium according to claim 7, wherein the ten point mean roughness falls within a range of from 20 um to 55 um.

9. The stack recording medium according to claim 7, wherein the region having an adhesive property has an adhesive strength ranging from 300 gf/25 mm to 800 gf/25 mm as measured buy a 180° peeling test in accordance with JIS Z 1528.

10. The stack recording medium according to claim 7, wherein the region having an adhesive property has an adhesive strength ranging from 300 gf/25 mm to 500 gf/25 mm as measured by a 180° peeling test in accordance with JIS Z 1528.

11. The stack recording medium according to claim 7, wherein the thickness of the base sheet falls within a range of from 125 um to 200 um.

12. The stack recording medium according to claim 7, wherein the base sheet is a plastic film.

* * * * *

UNITED STATES PATENT AND TRADEMARK OFFICE

CERTIFICATE OF CORRECTION

PATENT NO. : 6,090,463

DATED : July 18, 2000

INVENTOR(S) : MAMORU SAKAKI ET AL.

It is certified that error appears in the above-identified patent and that said Letters Patent is hereby corrected as shown below:

COVER

ITEM 56, "0531992 3/1972" should read --0531992 3/1992--.

COLUMN 1:

Line 63, "a" should be deleted.

COLUMN 3:

Line 25, "A um" should read - A μm--.

COLUMN 4:

Line 50, "plenty" should read --quantity--;
Line 60, "plenty," should read --quantity,--.

COLUMN 6:

Line 37, "a the" should read --at the--;
Line 44, "from 20" should read --from 20 μm-;
Line 66, "o f Rz" should read --of Rz-.

UNITED STATES PATENT AND TRADEMARK OFFICE

CERTIFICATE OF CORRECTION

PATENT NO. : 6,090,463

DATED : July 18, 2000

INVENTOR(S) : MAMORU SAKAKI ET AL.

It is certified that error appears in the above-identified patent and that said Letters Patent is hereby corrected as shown below:

COLUMN 7:

Line 32, "so far" should read --as far--;
Line 49, "from 125" should read --from 125 μm--.

COLUMN 8:

Line 23, "other" should read --another--.

COLUMN 9:

Line 22, "5 um)" should read --5 μm)--;
Line 25, "Stockigt" should read --Stöckigt-;
Line 65, "jammed" should read --were jammed--.

COLUMN 11:

Line 49, "15 um to 60 um" should read --15 μm to 60 μm--.

UNITED STATES PATENT AND TRADEMARK OFFICE

CERTIFICATE OF CORRECTION

PATENT NO. : 6,090,463

DATED : July 18, 2000

INVENTOR(S) : MAMORU SAKAKI ET AL.

It is certified that error appears in the above-identified patent and that said Letters Patent is hereby corrected as shown below:

COLUMN 12:

Line 27, "15 um to 60 um" should read --15 μm to 60 μm-;
Line 30, "ship" should read --ship:--;
Line 38, "20 um to 55 um." should read --20μm to 55μm.--;
Line 43, "buy" should read --by--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*